US010603598B2

(12) United States Patent
Kwan

(10) Patent No.: US 10,603,598 B2
(45) Date of Patent: Mar. 31, 2020

(54) HINGE MECHANISM FOR A DOOR OF A MODEL CAR

(71) Applicants: GATEWAY AUTOART LIMITED, Tsuen Wan (CN); GATEWAY AUTOART JAPAN CORPORATION, Fuefuki-shi (JP)

(72) Inventor: Kelvin Yuet-Ming Kwan, Hong Kong (HK)

(73) Assignees: GATEWAY AUTOART LIMITED, Tsuen Wan (CN); GATEWAY AUTOART JAPAN CORPORATION, Fuefuki-Shi (JP)

( * ) Notice: Subject to any disclaimer, the term of this patent is extended or adjusted under 35 U.S.C. 154(b) by 0 days.

(21) Appl. No.: 16/242,334

(22) Filed: Jan. 8, 2019

(65) Prior Publication Data

US 2019/0336874 A1 Nov. 7, 2019

(30) Foreign Application Priority Data

May 7, 2018 (CN) ..... 2018 1 0425901

(51) Int. Cl.
*A63H 17/26* (2006.01)
*E05D 3/02* (2006.01)

(52) U.S. Cl.
CPC ..... *A63H 17/262* (2013.01); *E05D 3/02* (2013.01); *E05Y 2600/51* (2013.01); *E05Y 2900/60* (2013.01)

(58) Field of Classification Search
CPC ..... A63H 17/00; A63H 17/26; A63H 17/262; A63H 17/002; Y10T 16/00; Y10T 16/52;
(Continued)

(56) References Cited

U.S. PATENT DOCUMENTS 5,022,884 A * 6/1991 Hippely ..... A63H 17/02 446/14
5,083,969 A 1/1992 Wagener
(Continued)

FOREIGN PATENT DOCUMENTS

CN 205850228 U 1/2017
JP S5246996 U 4/1977
WO 2008009100 A1 1/2008

OTHER PUBLICATIONS

Examination Report issued in foreign counterpart Australian Patent Application No. 2018205163.
(Continued)

*Primary Examiner* — Kien T Nguyen
(74) *Attorney, Agent, or Firm* — Ladas & Parry LLP

(57) ABSTRACT

The present disclosure relates to a hinge mechanism for a door of a model car, including: a pivot element made of metal, wherein the pivot element has a pivot axis and a base that could be mounted to a body of the model car; a lever arm made of metal, wherein the lever arm could be mounted to an inner surface of the door of the model car, and wherein the lever arm has at least one slot configured to receive the pivot axis of the pivot element; and a tension plate made of metal, wherein the tension plate is mounted to the lever arm and configured to press the pivot axis of the pivot element into the at least one slot of the lever arm.

14 Claims, 4 Drawing Sheets

(58) Field of Classification Search
CPC ..... Y10T 16/538; Y10T 16/558; Y10T 16/54038; E05D 3/00
USPC ..... 446/465, 470; 16/221, 254, 255, 16/257–259
See application file for complete search history.

(56) References Cited

U.S. PATENT DOCUMENTS

| | | | | |
|---|---|---|---|---|
| 5,794,309 | A | 8/1998 | Lotz | |
| 5,924,910 | A * | 7/1999 | Liu | A63H 17/26 446/435 |
| 2005/0283948 | A1 | 12/2005 | Hyde | |
| 2007/0277347 | A1 | 12/2007 | Doswell et al. | |
| 2017/0014724 | A1 | 1/2017 | Kwan | |

OTHER PUBLICATIONS

Machine English translation of CN205850228.
English translation of JPS5246996U.
English translation of Office Action dated Oct. 30, 2019 issued in corresponding Japanese Patent Application No. 2018-227214.

* cited by examiner

HINGE MECHANISM FOR A DOOR OF A MODEL CAR

BACKGROUND

1. Field of the Invention

The disclosed invention relates to a hinge mechanism used for a door of a model car, especially a car made of plastic.

2. Description of Related Art

Conventionally, a car type model (a minicar) is broadly popular as a toy for children or as ornaments aesthetically enjoyed by adults. For this reason, there is a demand to finely fabricate a minicar in order to imitate an authentic car as close as possible. Therefore, there are minicars offered for ornamental purposes which capture authentic cars inside and out.

Generally, the common door hinge mechanism on a plastic model car comprises a plastic lever arm with a hole, usually slim in shape, rotating around a pivot element. Further, the pivot element is either made of metal or plastic. Plastic is flexible but not hard enough. The hole of the plastic lever arm tends to wear out under constant rubbing with the pivot after constant opening and closing of the door. A clearance in the rotational movement of the hinge will be created, and thus the door will be more and more loosely fitted and not closed to the right position. At the same time, the tightly fitted door will not stay open and swing freely. The slim plastic lever arm also flexes when opening and closing the door, which tends to change the door closing position and therefore not shut evenly and flush along the body surface.

SUMMARY OF THE INVENTION

A high-end collectable model car selling at a high price requires all the doors to shut evenly and flush along the body surface. The doors need to stay firmly closed when they are not opened by hand, or stay open when they are not closed by hand. Because of this, the door hinge of such model car, just like a real car, requires a restriction on the door to open and close in the intended position. All the moving and rubbing parts in the door hinge must be made with metal for its durability and rigidity, which will not wear-out easily after repeatedly rubbing with each other and will not deform after prolonged use.

According to one exemplary embodiment of the disclosed invention, a hinge mechanism used for a model car comprises a pivot element made of metal, a lever arm made of metal and a tension plate made of metal. The pivot element has a pivot axis and a base which could be attached to a body of the model car. The lever arm could be attached to an inner surface of the door of the model car and has at least one slot configured to receive the pivot axis of the pivot element. The tension plate is mounted to the lever arm and configured to press the pivot axis of the pivot element into the at least one slot of the lever arm.

According to another exemplary embodiment of the disclosed invention, a model car comprises a body made of plastic, a hinge mechanism made of metal and a door made of plastic. The hinge mechanism comprises a pivot element, a lever arm and a tension plate. The pivot element has a pivot axis and a base which is attached to a body of the model car. The lever arm is attached to an inner surface of the door of the model car and has at least one slot configured to receive the pivot axis of the pivot element. The tension plate is mounted to the lever arm and configured to press the pivot axis of the pivot element into the at least one slot of the lever arm.

In order to further understand the disclosed invention, the following embodiments are provided along with illustrations to facilitate the appreciation thereof; however, the appended drawings are merely provided for reference and illustration, without any intention to be used for limiting the scope of the invention.

DETAILED DESCRIPTION OF THE PREFERRED EMBODIMENTS

The aforementioned illustrations and following detailed descriptions are exemplary for the purpose of further explaining the scope of the invention. Other objectives and advantages related to the invention will be illustrated in the subsequent descriptions and appended drawings.

Figure 1:
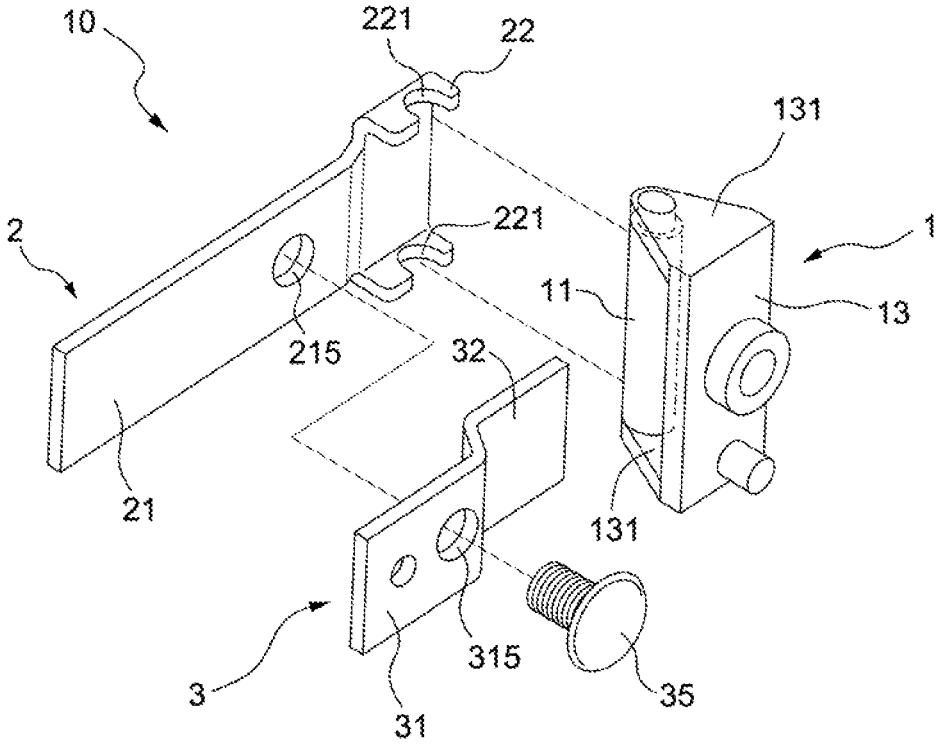
FIG. 1 is an exploded view showing a hinge mechanism in accordance with an embodiment of the disclosed invention.

As shown in FIG. 1, the hinge mechanism 10 in accordance with an embodiment of the invention comprises a pivot element 1, a lever arm 2 and a tension plate. The pivot element 1 is made of metal and made by die casting. The pivot element 1 has a pivot axis 11 and a base 13, wherein the base 13 has two bended wing portions 131 and the pivot axis 11 is arranged between these two wing portions 131. The lever arm 2 is made of metal, preferably made of stainless-steel. The lever arm 2 is configured to be attached to the door of the model car and has a stem portion 21 and a head portion 22. The stem portion 21 has a thread hole 215. The head portion 22 has two bended portions 220 and these two bended portions have two corresponding U-shaped slots 221, respectively, wherein these two U-shaped slots 221 are configured to receive the pivot axis 11 of the pivot element 1. The tension plate 3 is made of metal, preferably made of steel. The tension plate 3 is slightly bended so as to form a first portion 31 and a second portion 32. The first portion 31 of the tension plate 3 has a thread hole 315 corresponding to the thread hole 215 of the lever arm 2. The first portion 31 of the tension plate 3 is configured to be mounted to the stem portion 21 of the lever arm 2 and the second portion 32 of the tension plate is configured to press the pivot axis 11 of the pivot element 1 into the two U-shaped slots 221 of the lever arm when the first portion 31 of the tension plate is mounted to the stem portion 21 of the lever arm 2.

Figure 2:
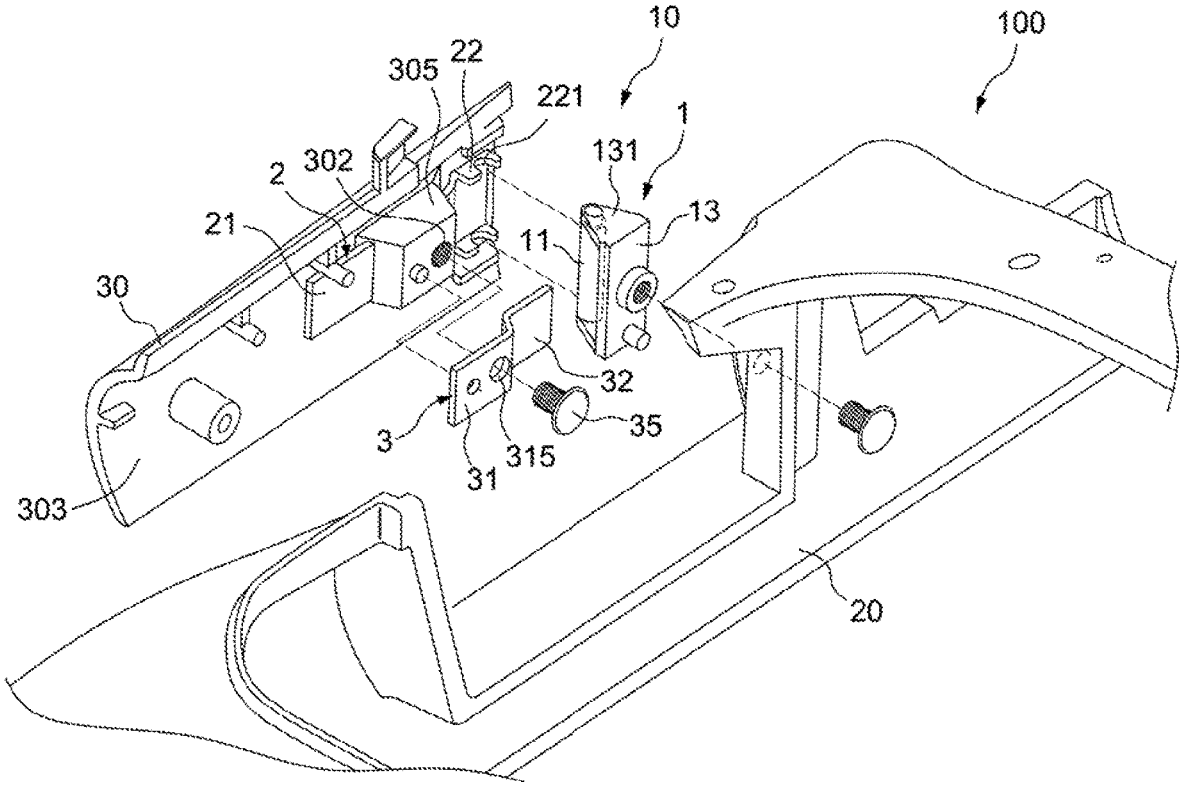
FIG. 2 is an exploded view showing a model car with a hinge mechanism in accordance with an embodiment of the disclosed invention.

FIG. 2 is an exploded view showing a model car 100 with a hinge mechanism 10 in accordance with an embodiment of the invention. The model car 100 has a body 20 and a door 30, wherein both the body 20 and the door 30 are made of plastic. Referring to FIG. 2, the base 13 of the pivot element 1 is mounted to the body 20 of the model car 100. The lever arm 2 is mounted to the inner surface 303 of the door 30 of the model car. Especially, the lever arm 2 is abutted on the inner surface 303 of the door 30 by mean of "insert-molding." "Insert molding" is a unique technology in plastic model car manufacturing. Regarding the process of "insert molding," the lever arm 2 is placed in a steel mold at a designated position, wherein the steel mold is used for manufacturing the plastic door 30. Then the melted plastic is injected into the steel mold and will wrap around the lever arm 2. After the melted plastic becomes solidified to form the plastic door 30, the lever arm 2 is integrated with the plastic door 30 and cannot be separated from the door 30. As shown in FIG. 2, the stem portion 21 of the lever arm 2 is partially embedded into the abutment 305 which is integrated with the inner surface 303 of the door 30 and be a part of the door 30. Such process provides a long-lasting effect that the lever arm 2 will never become loose.

Except for "insert-molding," the lever arm 2 could be abutted on the inner surface 303 of the door 30 by other means. For example, the lever arm 2 could he directly mounted on the inner surface 303 of the door 30 by mean of screwing. As another example, the lever arm could be attached to the inner surface 303 of the door 30 by mean of gluing. Further, as another example, the lever arm 2 is abutted on the inner surface 303 of the door 30 by mean of "heat-sticking." Regarding the process of "heat-sticking," several small plastic pins are made to protrude from the inner surface 303 of the door 30 and the lever arm 2 abuts on the inner surface 303 of the door 30 with small holes for the plastic pins to penetrate. A tool with heated tip will flatten the heads of the plastic pins such that the heads of the plastic pins are formed to be the riveting heads to secure the fixture of the lever arm 2.

The pivot axis 11 of the pivot element 1 is received in the slots 221 of the head portion 22 of the lever arm 2 such that the lever arm 2 could be rotated about the pivot axis 11. That is, the door 30 could be moved relative to the body 20.

Figure 3:
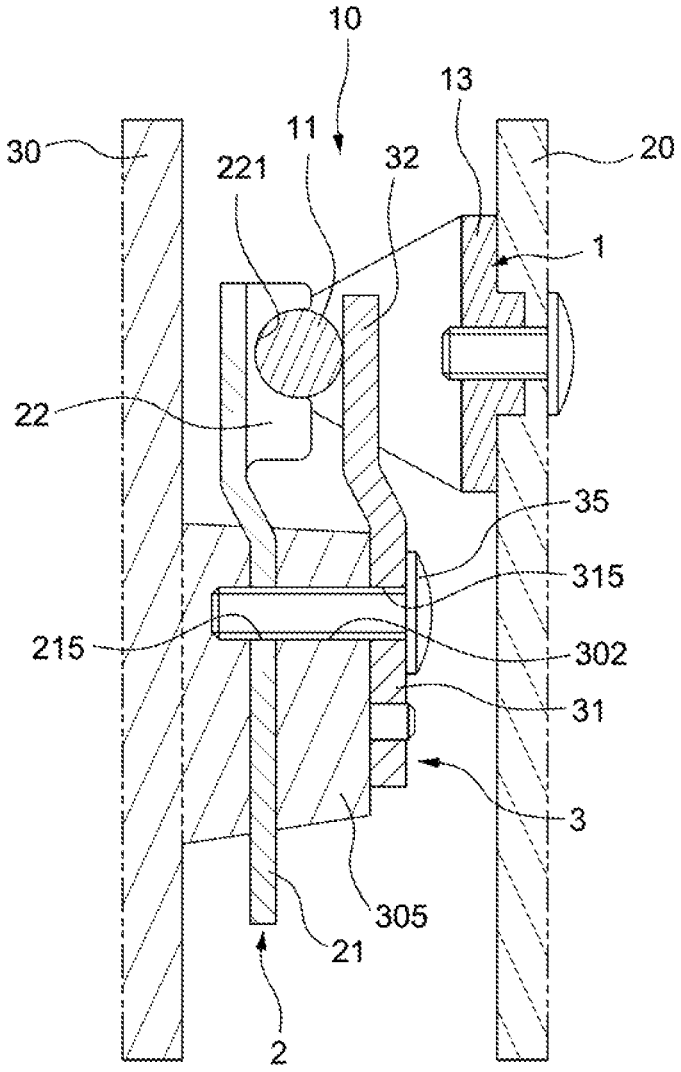
FIG. 3 is a schematic view showing a door with a hinge mechanism in accordance with an embodiment of the disclosed invention in a closed position.
Figure 4:
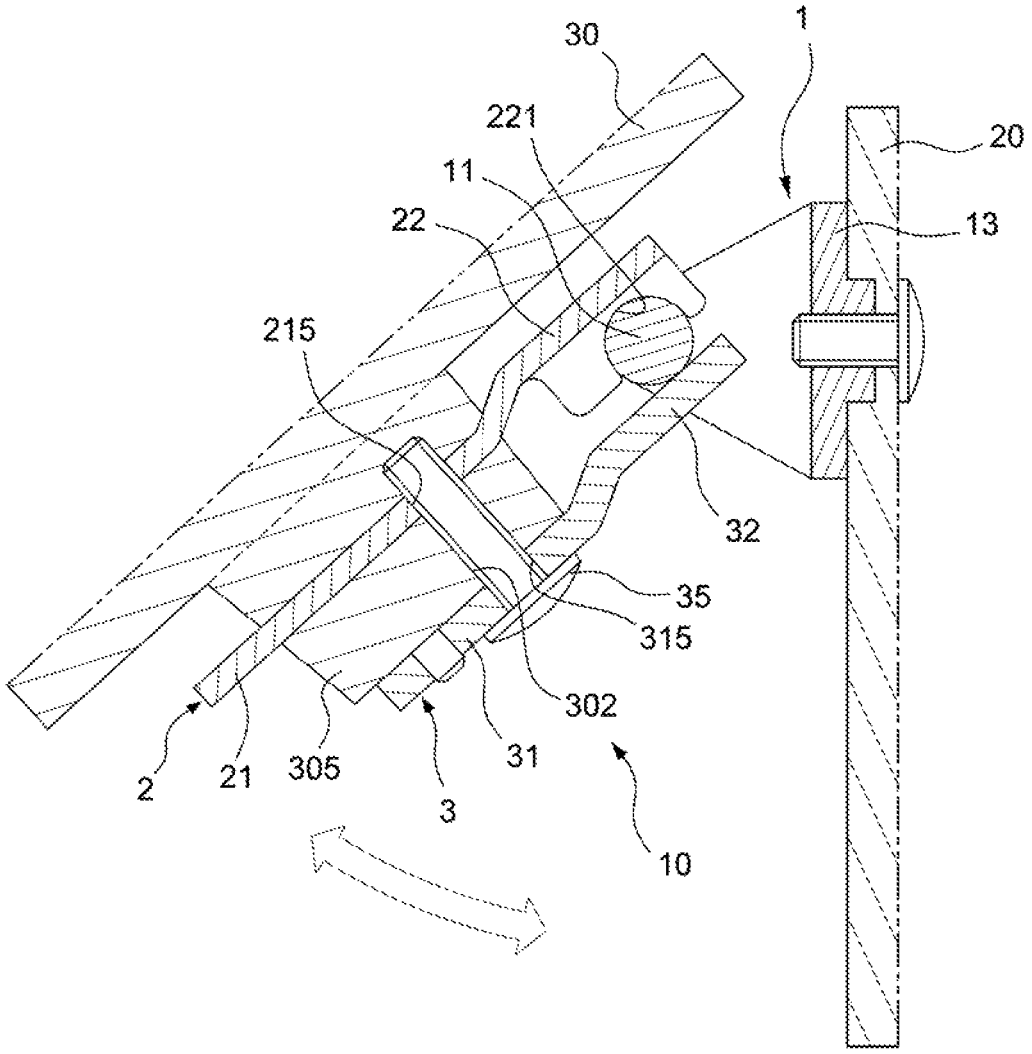
FIG. 4 is a schematic view showing a door with a hinge mechanism in accordance with an embodiment of the disclosed invention in an open position.

The abutment 305 has a thread hole 302 aligning with the thread hole 215 of the stem portion of the lever arm 2 (see FIGS. 3 and 4). The first portion 31 of the tension plate 3 is arranged on the abutment 305 and the thread hole 315 of the first portion 31 of the tension plate 31 aligns with the thread hole 302 of the abutment 305. A screw 35 is threaded through the thread hole 315 of the first portion 31 of the tension plate 31, the thread hole 302 of the abutment 305 and the thread hole 215 of the stem portion of the lever arm 2 (see FIGS. 3 and 4) such that the tension plate 3 is securely mounted to the lever arm 2. When the first portion 31 of the tension plate 3 is mounted to the lever arm 2, the second portion 32 of the tension plate 3 extends into the space between the pivot axis 11 and the base 13 of the pivot element 1 and press the pivot axis 11 of the pivot element 1 into the recesses 221 of the head portion 22 of the lever arm 2.

FIG. 3 is a schematic view showing a door 30 with a hinge mechanism 10 in accordance with an embodiment of the invention at closed position, and FIG. 4 is a schematic view showing a door 30 with a hinge mechanism 10 in accordance with an embodiment of the invention at open position. As shown in FIGS. 3 and 4, whether the door is at the closed position or at the open position, the tension plate 3 always presses the pivot axis 11 of the pivot element 1 such that the pivot axis 11 of the pivot element 1 is firmly received in the slots 221 of the lever arm 2. Since the tension plate 3 always firmly presses the pivot axis 11 of the pivot element into the slots 221 of the lever arm 2, a frictional movement between the pivot element 1 and the lever arm 2 will be created so as to prevent the door 30 from swinging freely. That is, the door 30 will firmly stay at the correct closed position unless the door 30 is opened by hand. Likewise, the door 30 will firmly stay at the intended open position unless the door is closed by hand.

In addition, as mentioned above, the pivot element 1, the lever arm 2 and the tension plate 3 are made of metal. When they are rubbed against each other, the wear of them will be minimal. Thus, after opening and closing the door 30 repeatedly, the tightness between the components of the hinge mechanism 10 will remain and the door 30 will not be loose in the movement and will not swing freely.

However, the above embodiments merely describe the principle and effects of the present disclosure instead of being used to limit the present disclosure. Therefore, persons skilled in the art can make modifications and variations to the above embodiments without departing from the spirit of the present disclosure. The scope of the present disclosure should be defined by the appended claims.

What is claimed is:

1. A hinge mechanism for a door of a model car, comprising:

a pivot element made of metal, wherein the pivot element has a pivot axis and a base that is mountable to a body of the model car;

a lever arm made of metal, wherein the lever arm is mountable to an inner surface of the door of the model car, and wherein the lever arm has at least one slot configured to receive the pivot axis of the pivot element such that, with the lever arm mounted to the inner surface of the door and the pivot axis received in the at least one slot of the lever arm, rotation of the lever arm relative to the pivot element can move the door between a plurality of positions, including an open position and a closed position; and a tension plate made of metal, wherein the tension plate is mounted to the lever arm and configured to press the pivot element into the at least one slot of the lever arm in all of the plurality of positions to which rotation of the lever arm relative to the pivot element moves the door.

2. The hinge mechanism of claim 1, wherein the pivot element is made by die casting.

3. The hinge mechanism of claim 1, wherein the lever arm is made of stainless steel.

4. The hinge mechanism of claim 1, wherein the tension plate is made of steel.

5. The hinge mechanism of claim 1, wherein the lever arm has two slots formed at its end.

6. The hinge mechanism of claim 1, wherein the lever arm has a thread hole and the tension plate has a thread hole substantially corresponding to the thread hole of the lever arm.

7. A model car, comprising:

a body made of plastic;

a door made of plastic;

a hinge mechanism comprising:

a pivot element made of metal, wherein the pivot element has a pivot axis and a base mounted to the body of the model car;

a lever arm made of metal and mounted to the door, wherein the lever arm has at least one slot configured to receive the pivot axis of the pivot element such that, with the pivot axis received in the at least one slot of the lever arm, rotation of the lever arm relative to the pivot element can move the door between a plurality of positions, including an open position and a closed position; and a tension plate made of metal, wherein the tension plate is mounted to the lever arm and configured to press the pivot axis of the pivot element into the at least one slot of the lever arm in all of the positions to which rotation of the lever arm relative to the pivot element moves the door.

8. The model car of claim 7, wherein the pivot element is made by die casting.

9. The model car of claim 7, wherein the lever arm is made of stainless steel.

10. The model car of claim 7, wherein the tension plate is made of steel.

11. The model car of claim 7, wherein the lever arm has two slots formed at its end.

12. The model car of claim 7, wherein the lever arm is configured to form an integral part of the door.

13. The model car of claim 7, wherein the lever arm is mounted to an inner surface of the door by mean of insert molding.

14. The model car of claim 7, wherein the door comprises an abutment integrated with an inner surface of the door, and wherein the lever arm is partially embedded into the abutment and the tension plate is partially arranged on the abutment, and wherein the lever arm has a thread hole and the abutment has a thread hole substantially aligning with the thread hole of the lever arm and the tension plate has a thread hole aligning with the thread hole for the abutment, and wherein a screw is threaded through these holes.

* * * * *